US009380843B2

(12) United States Patent
Logian et al.

(10) Patent No.: US 9,380,843 B2
(45) Date of Patent: Jul. 5, 2016

(54) MULTI-PIECE JEWELRY SET

(71) Applicants: Ashot Logian, New York, NY (US); Arthur Sargsyan, New York, NY (US)

(72) Inventors: Ashot Logian, New York, NY (US); Arthur Sargsyan, New York, NY (US)

( * ) Notice: Subject to any disclaimer, the term of this patent is extended or adjusted under 35 U.S.C. 154(b) by 80 days.

(21) Appl. No.: 14/277,130

(22) Filed: May 14, 2014

(65) Prior Publication Data

US 2014/0345322 A1 Nov. 27, 2014

Related U.S. Application Data

(60) Provisional application No. 61/866,150, filed on Aug. 15, 2013, provisional application No. 61/823,547, filed on May 15, 2013.

(51) Int. Cl.

| | |
|---|---|
| ***A44C 5/00*** | (2006.01) |
| ***A44C 15/00*** | (2006.01) |
| ***A44C 13/00*** | (2006.01) |
| ***A44C 25/00*** | (2006.01) |
| ***A44C 5/02*** | (2006.01) |
| ***A44C 9/00*** | (2006.01) |

(52) U.S. Cl.

CPC ..... *A44C 15/006* (2013.01); *A44C 5/02* (2013.01); *A44C 9/0023* (2013.01); *A44C 13/00* (2013.01); *A44C 25/001* (2013.01)

(58) Field of Classification Search

None

See application file for complete search history.

(56) References Cited

U.S. PATENT DOCUMENTS

| | | | | |
|---|---|---|---|---|
| 606,617 | A | 6/1898 | Zirnkilton | |
| 876,902 | A | 1/1908 | Fuller | |
| 1,338,973 | A | 4/1920 | Brown | |
| 2,016,679 | A * | 10/1935 | Mayer | A44C 9/0023 63/15.1 |
| 4,841,746 | A | 6/1989 | Chen | |
| 4,932,396 | A | 6/1990 | Garris | |
| 5,419,158 | A | 5/1995 | Sandberg et al. | |
| 6,131,408 | A | 10/2000 | Gill | |
| 6,497,117 | B2 | 12/2002 | Ofiesh, II | |
| 6,526,779 | B2 | 3/2003 | Foote | |
| 6,594,871 | B2 | 7/2003 | Hoffman | |
| 6,701,747 | B2 | 3/2004 | Hartgrove | |
| 6,860,117 | B2 | 3/2005 | Turpanjian et al. | |
| 7,269,973 | B2 | 9/2007 | Koren | |
| 7,287,400 | B1 | 10/2007 | Baum et al. | |
| 7,481,075 | B2 | 1/2009 | Lindenman | |
| 8,316,666 | B2 | 11/2012 | Patterson | |
| 2006/0090511 | A1 | 5/2006 | Boone | |
| 2007/0006615 | A1 * | 1/2007 | Noda | A44C 25/001 63/26 |
| 2007/0186584 | A1 | 8/2007 | Varcin | |
| 2009/0151395 | A1 | 6/2009 | Louuk et al. | |

FOREIGN PATENT DOCUMENTS

| | | |
|---|---|---|
| EP | 1767113 | 3/2007 |
| WO | 9912442 | 3/1991 |

OTHER PUBLICATIONS http://www.fantasyjewelrybox.com/r9401.html; Internet page printed on Mar. 19, 2003.

* cited by examiner

*Primary Examiner* — Jack W Lavinder

(74) *Attorney, Agent, or Firm* — Gearhart Law, LLC

(57) ABSTRACT

A multi-piece jewelry is disclosed where the jewelry is formed of interlockable and interchangeable circular elements. The multi-piece jewelry of this disclosure allows the user to easily assemble the elements of the jewelry in various designs without any tools. A kit comprising the elements is also disclosed to combine the elements in different ways to form a number of different designs. The jewelry of this invention may be a bracelet or ring. The kit may also comprise pendants, earrings, hair accessories or other jewelry.

11 Claims, 10 Drawing Sheets

MULTI-PIECE JEWELRY SET

PRIORITY

Figure 1:
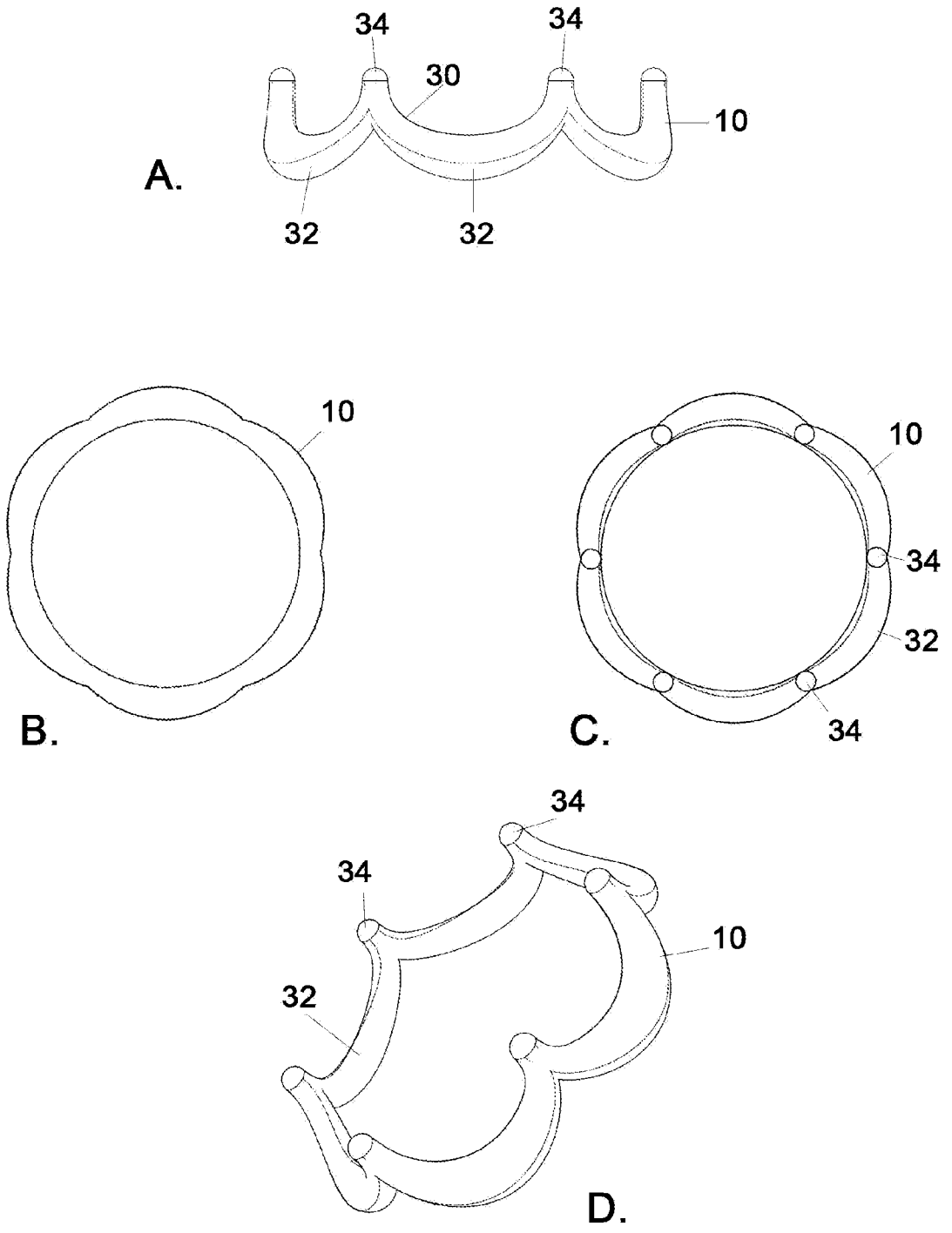

This application claims priority to U.S. Application Ser. No. 61/823,547 filed on May 15, 2013 and U.S. Application Ser. No. 61/866,150 filed on Aug. 15, 2013, the contents of both of which are herein fully incorporated by reference in their entirety.

FIELD OF THE INVENTION

This invention relates to jewelry, more specifically to rings, and bracelets.

BACKGROUND OF THE INVENTION

In the art of jewelry rings consisting of multiple parts are known in various forms.

U.S. Pat. No. 1,338,973 discloses a plurality of connected links that may be assembled to a unit ring.

U.S. Pat. No. 5,419,158 discloses a set of wrap rings interconnected by pivoting assembly. The assembly provides a plurality of rings that can be connected together with a pivoting pin through holes or bearings in the rings.

U.S. Pat. No. 7,269,973 discloses a multi-stone circular ring with U-shaped seats for stones, where each U-shaped seat supports a separate stone.

US application 2007/0186584 provides pairs of rings that match together through a raised pattern on the edge of the rings. The matching is individual and only two specific rings match together.

Thus the previous art provides rings that may be connected together with pivoting pins, specially cut edges or connecting links. None of the known art provides a multi-piece jewelry that would allow the user to make different designs of rings and bracelets with few elements.

SUMMARY OF THE INVENTION

This invention provides solutions to the flaws of the known art and others.

Therefore, it is an object of this invention to provide a multi piece jewelry that allows the user to make different designs of rings and bracelets with few elements. The elements are interchangeable and interlockable. The multi-piece jewelry of this invention gives the user a large number of options to assemble the elements together. The multi-piece jewelry of this invention does not require any tools to be assembled to a selected design, nor does the user need any tools to change the design. The elements of the multi-piece jewelry of this invention are simple and can be used alone or in various combinations with each other. The jewelry may be rings or bracelets, but the concept is applicable to other jewelry also, such as tiaras, necklaces or hair accessories.

It is an object of this invention to provide a shaped circular element for a multi-piece jewelry, said shaped circular element comprising a multitude of substantially U-shaped forms connected to each other, said substantially U-shaped forms having a bottom and two tips and each adjacent substantially U-shaped form sharing one tip, whereby the element has an equal number of tips, bottoms and substantially U-shaped forms.

It is another object of this invention to provide a multi-piece jewelry, comprising at least one flat circular element and at least one shaped circular element, said shaped circular element comprising a multitude of substantially U-shaped forms connected to each other, said substantially U-shaped forms having a bottom and two tips and each adjacent substantially U-shaped form sharing one tip, whereby the element has an equal number of tips, bottoms and substantially U-shaped forms.

It is yet another object of the invention to provide a multi-piece jewelry, comprising at least two shaped circular elements, said shaped elements comprising a multitude of substantially U-shaped forms connected to each other, said substantially U-shaped forms having a bottom and two tips and each adjacent substantially U-shaped form sharing one tip, whereby the element has an equal number of tips, bottoms and substantially U-shaped forms and wherein shaped circular elements may interlocked together to form a unite structure.

It is still an object of the invention to provide a kit to form a multi-piece jewelry, said kit comprising at least one flat circular element, at least one shaped circular element having a multitude of substantially U-shaped forms connected to each other, said substantially U-shaped forms having a bottom and two tips and each adjacent substantially U-shaped form sharing one tip, whereby the shaped circular element has an equal number of tips, bottoms; and instructions to interlock the shaped elements and to combine the circular elements in multiple ways to form different designs of jewelry.

SHORT DESCRIPTION OF THE FIGURES

FIG. 1 A-D shows a shaped circular element of the multi piece jewelry with six U-shaped forms.

A. Side view of the shaped circular element to be used alone or in combination with one more other pieces of this invention to form a bracelet or a ring.
B. Bottom perspective of the element shown in A.
C. Top view of the element shown in A and B.
D. Top perspective view of the element shown in A, B and C.

Figure 2:
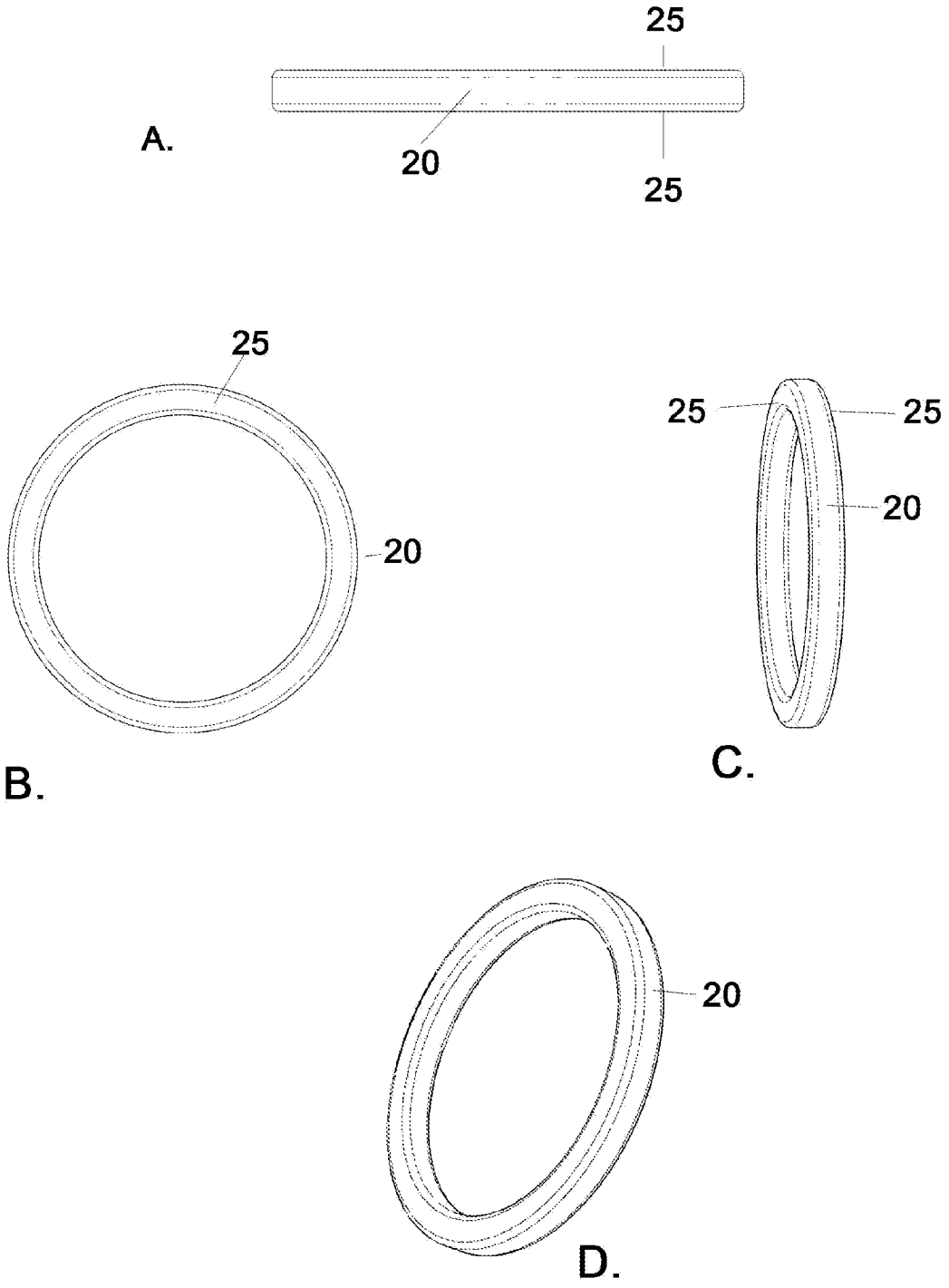

FIG. 2 A-D shows a flat circular element of the multi piece jewelry.

A. Side view of the flat circular element to be used alone or in combination with one or more other pieces of this invention to form a bracelet or a ring.
B. Bottom or top perspective of the element shown in A.
C. Side perspective view of the element shown in A, and B.
D. Top perspective view of the element shown in A, B and C.

Figure 3:
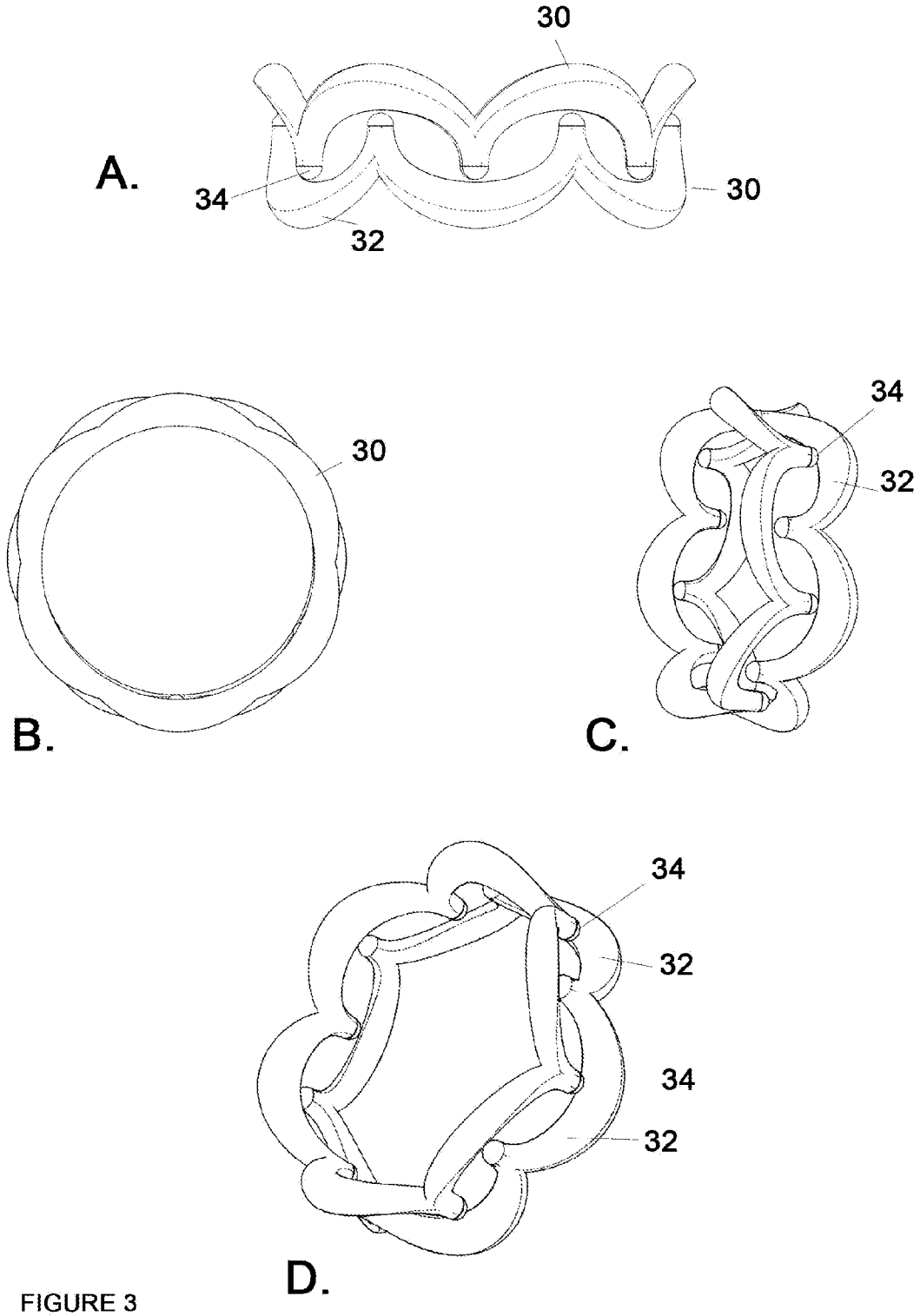

FIG. 3 A-. shows an assembly of a ring or a bracelet with two shaped circular elements.

A. Side view.
B. Bottom view.
C. Side perspective view.
D. Top perspective view.

Figure 4:
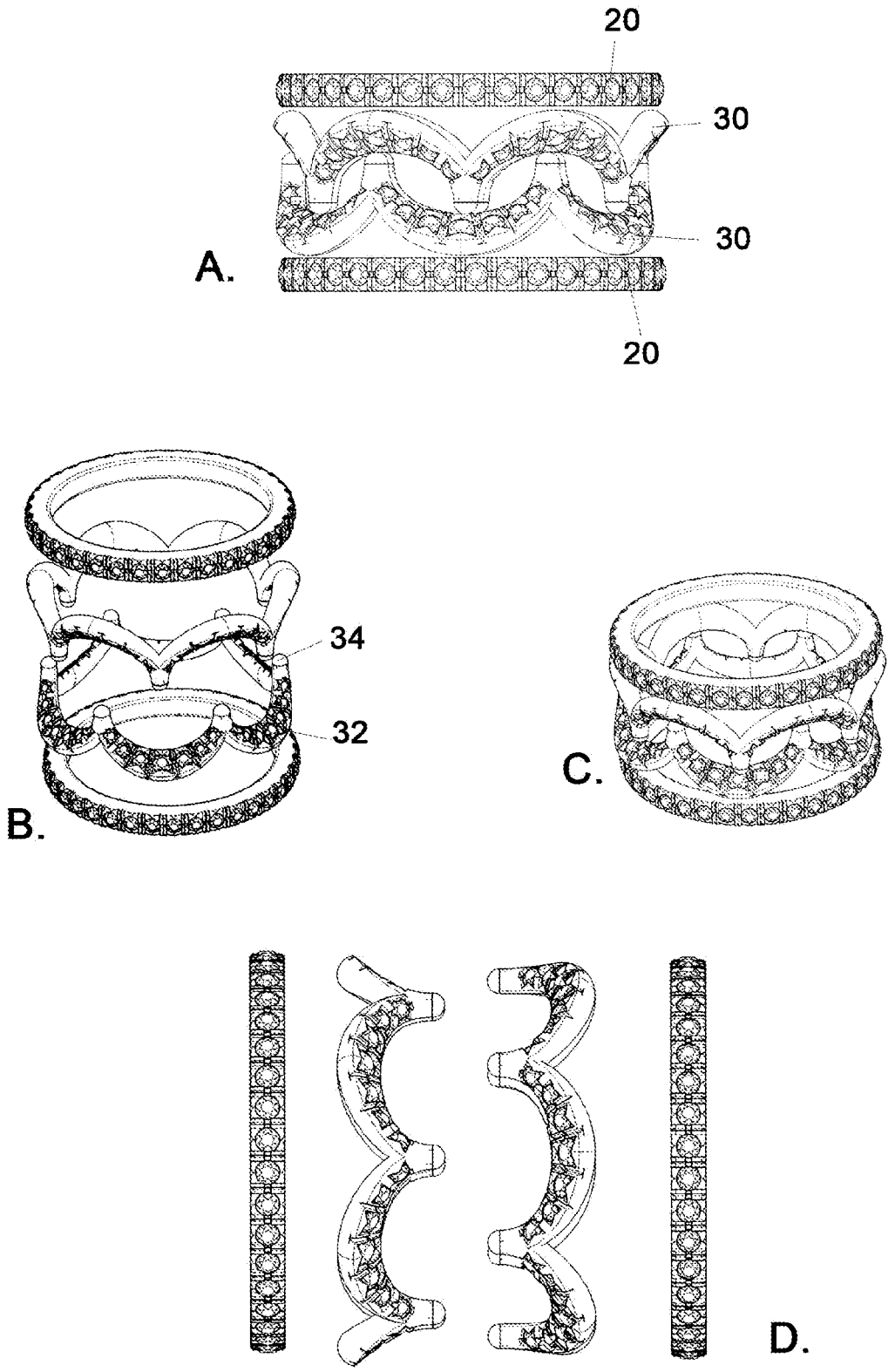

FIG. 4 A-D shows an assembly of a multi piece jewelry having two flat circular elements and two shaped circular elements.

A. Side view showing the elements interlocked
B. Side perspective view showing the elements separately.
C. Side perspective view showing the elements interlocked.
D. Side view showing the elements separately.

Figure 5:
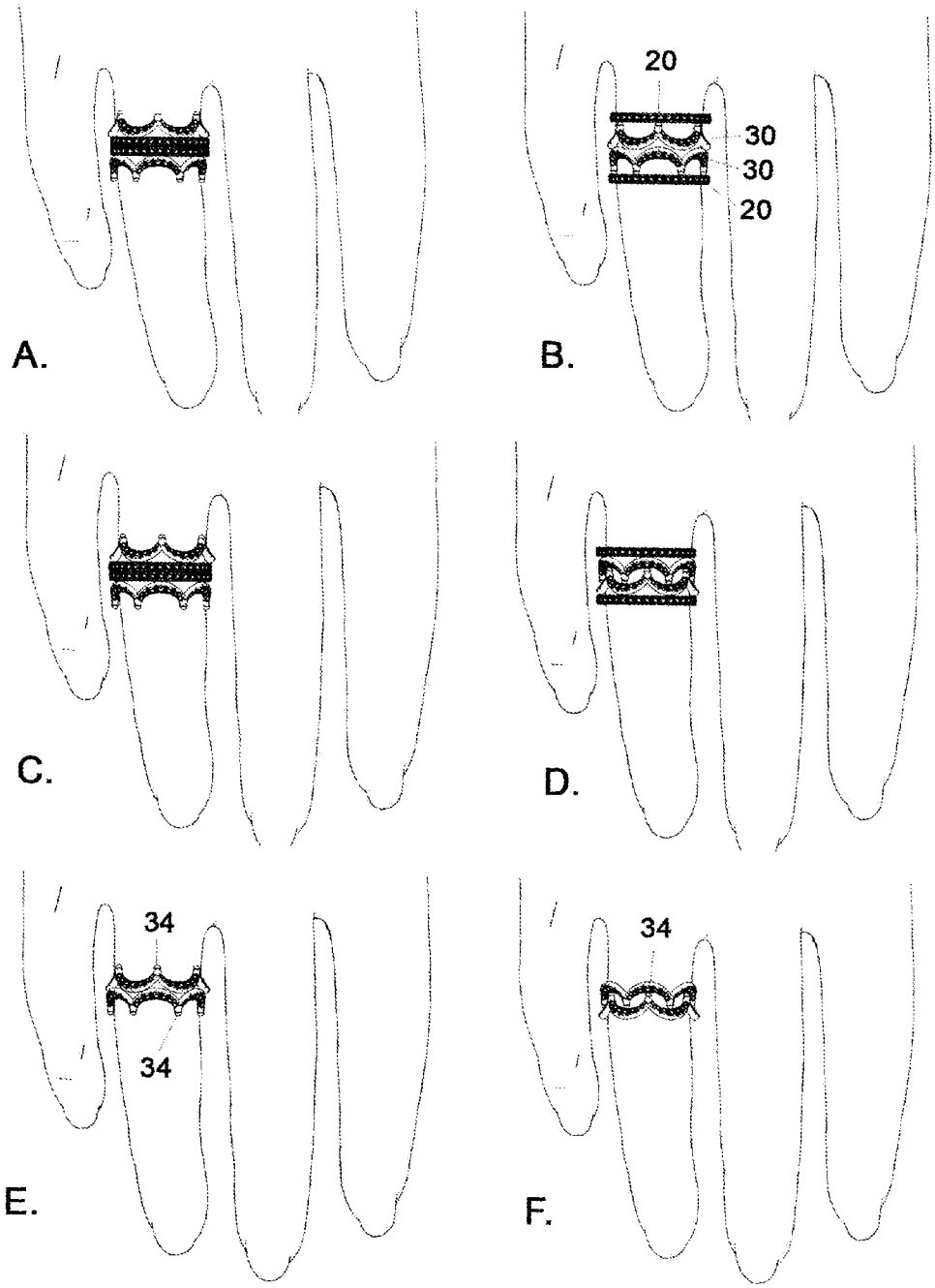

FIG. 5 A-F shows various assemblies to combine two shaped circular elements and/or two flat circular elements to form a unite ring structure.

A. Two flat circular elements form middle-section of the ring and the shaped circular elements on both sides of the middle section the bottom of the U-shaped form toward the middle section.

B. The two shaped circular elements form the middle section of the ring with the bottom of the U-shaped forms toward the middle, and the flat circular elements are on both sides of the middle section.

C. Two flat circular elements form middle-section of the ring and the shaped circular elements on both sides of the middle section the bottom of the U-shaped form toward the middle section.

D. The two shaped circular elements form the middle section of the ring with the bottom of the U-shaped forms away from the middle, and the flat circular elements are on both sides of the middle section.

E. Two shaped circular elements with the bottom of the U-shaped forms toward the middle.

F. Two shaped circular elements with the bottom of the U-shaped forms away from the middle.

Figure 6:
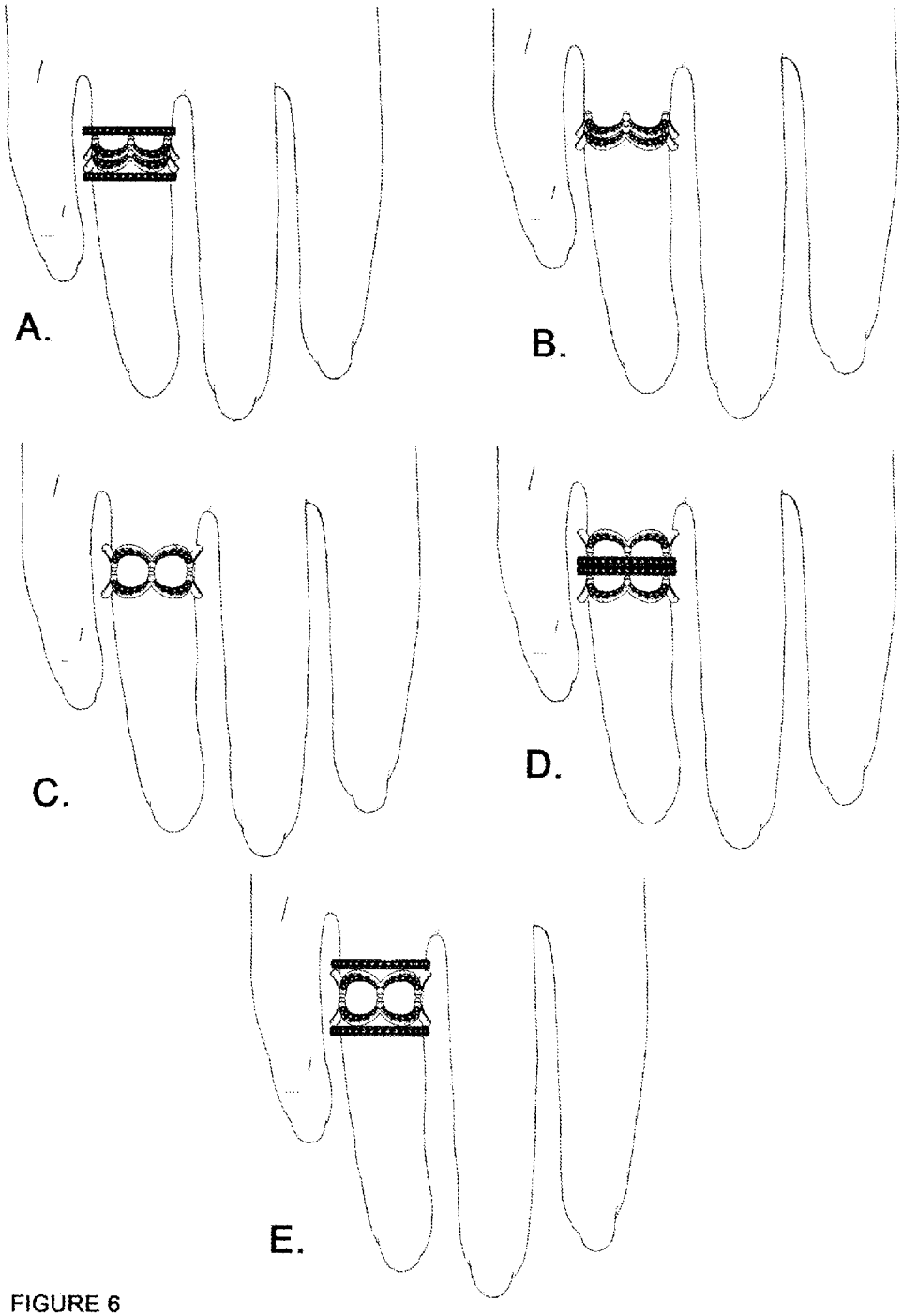

FIG. 6 A-E shows further assemblies to combine two shaped circular elements and/or two flat circular elements to form a unite ring structure.

A. Two shaped circular elements form the middle section of the ring with the bottom of the U-shaped forms toward same direction, and the flat circular elements are on both sides of the middle section.

B. Two shaped circular elements with the bottom of the U-shaped forms toward same direction.

C. Two shaped circular elements with the bottom of the U-shaped forms away from the middle and the tips of the U-shaped forms of each element contacting each other.

D. Two flat circular elements form a middle-section of the ring and the shaped circular elements on both sides of the middle section the bottom of the U-shaped form away from the middle section.

E. Two shaped circular elements form the middle section with the bottom of the U-shaped forms away from the middle and the tips of the U-shaped forms of each element contacting each other. Two flat circular elements on both sides of the middle section.

Figure 7:
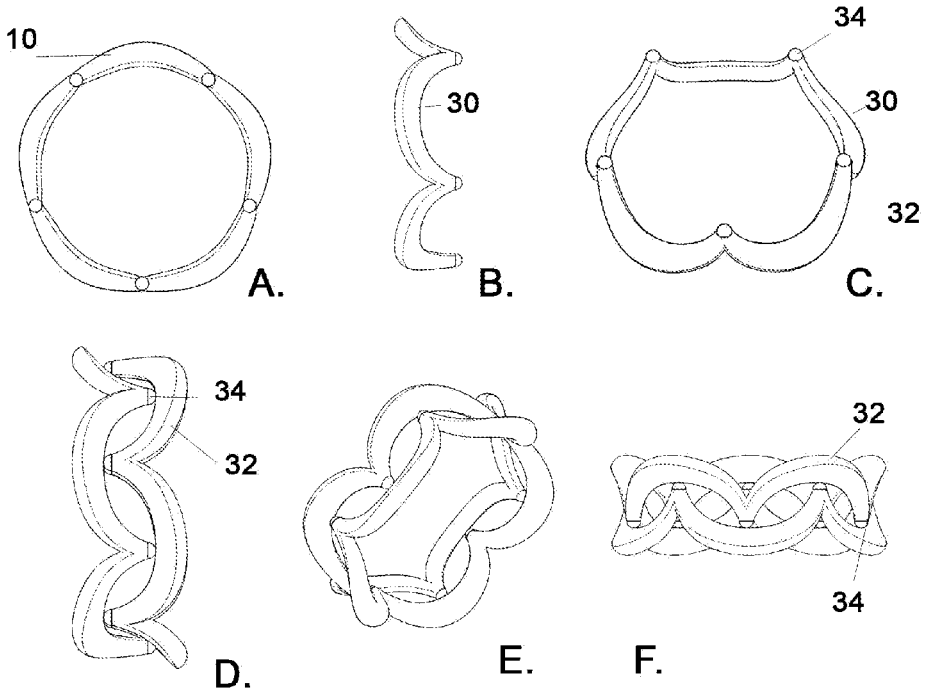

FIG. 7 shows shaped circular elements with five U-shaped forms.

A. A top view.

B. A side view.

C. A top perspective view.

D. A side view of two shaped circular elements with five U-shaped forms interlocked together by having the bottoms of the U-forms of one element coincide with the tips of the U-forms of the other element.

E. Top or bottom perspective view of the assembly of D.

F. A side perspective view of the assembly of D or E.

Figure 8:
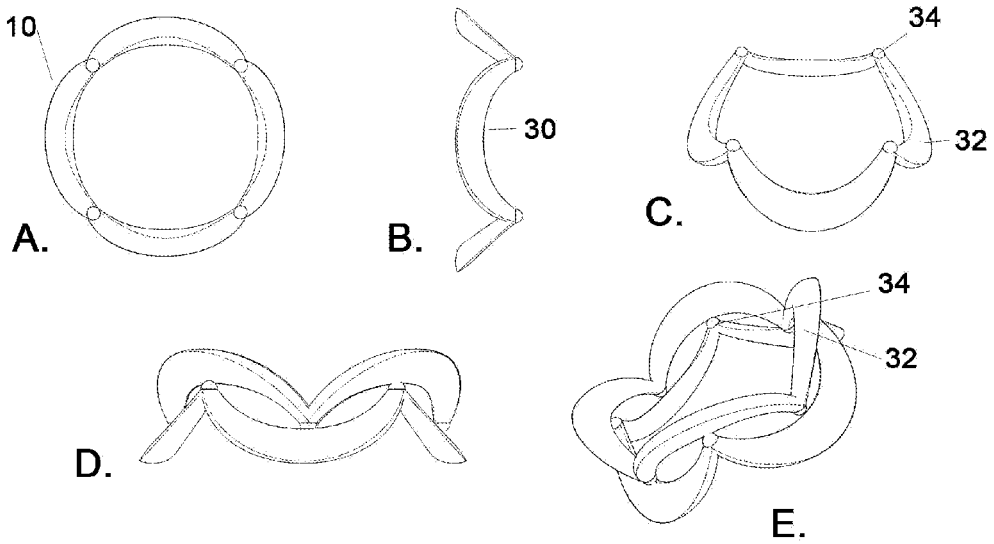

FIG. 8 shows shaped circular elements with four U-shaped forms.

A. A top view.

B. A side view.

C. A top perspective view.

D. A side view of two shaped circular elements with four U-shaped forms interlocked together by having the bottoms of the U-forms of one element coincide with the tips of the U-forms of the other element.

E. Top or bottom perspective view of the assembly of D.

Figure 9:
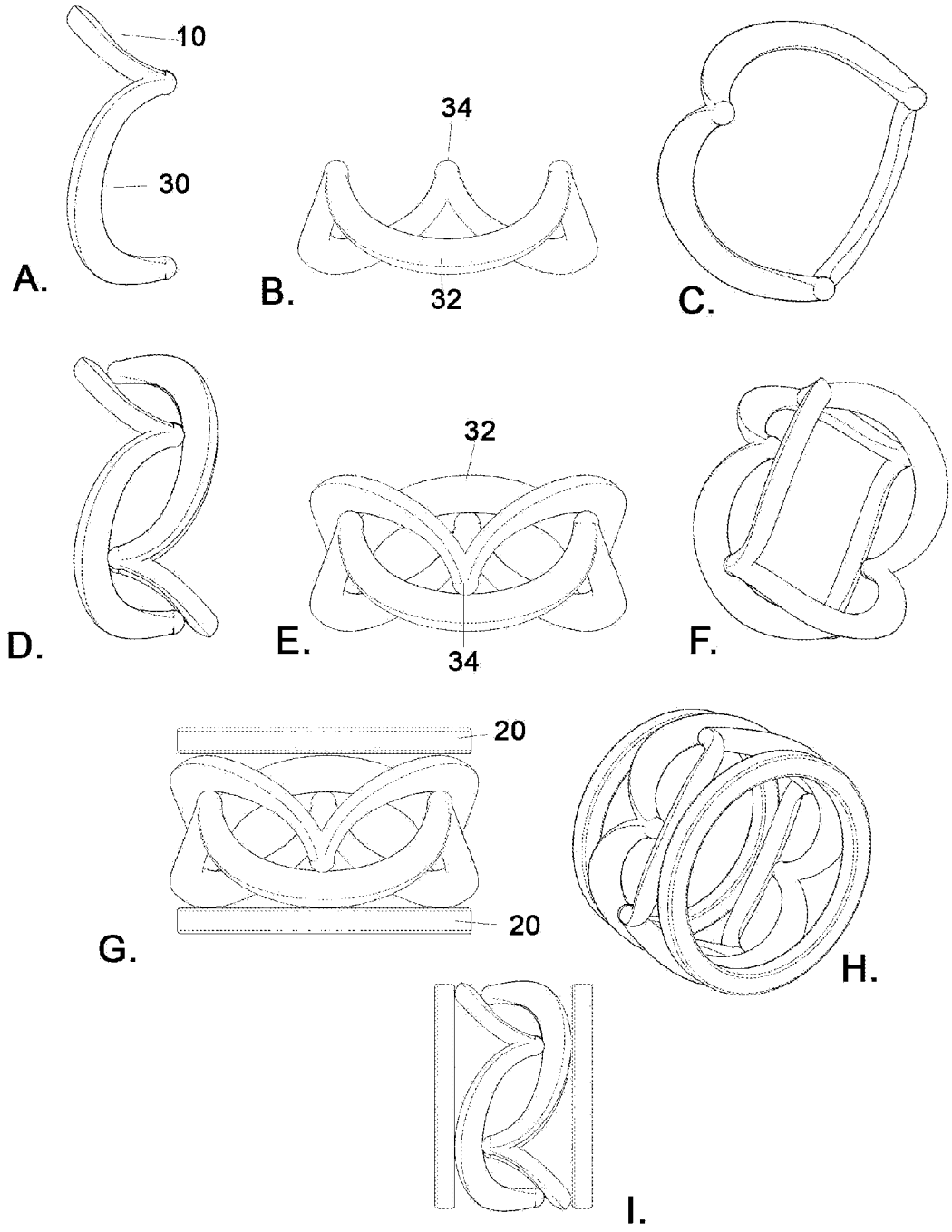

FIG. 9 A-I shows shaped circular elements with three U-shaped forms.

A. A side view

B. A perspective side view.

C. A top perspective view.

D. A side view of two shaped circular elements with three U-shaped forms interlocked together by having the bottoms of the U-forms of one element coincide with the tips of the U-forms of the other element.

E. A side perspective view of the assembly in D.

F. A top or bottom perspective view of the assembly in D and E.

G. A side perspective view of an assembly with two shaped circular elements as shown in D, E and F, forming a middle section and two flat circular elements on both sides of the middle section.

H. A bottom or top perspective view of assembly in G.

I. A side view of assembly in G and H.

Figure 10:
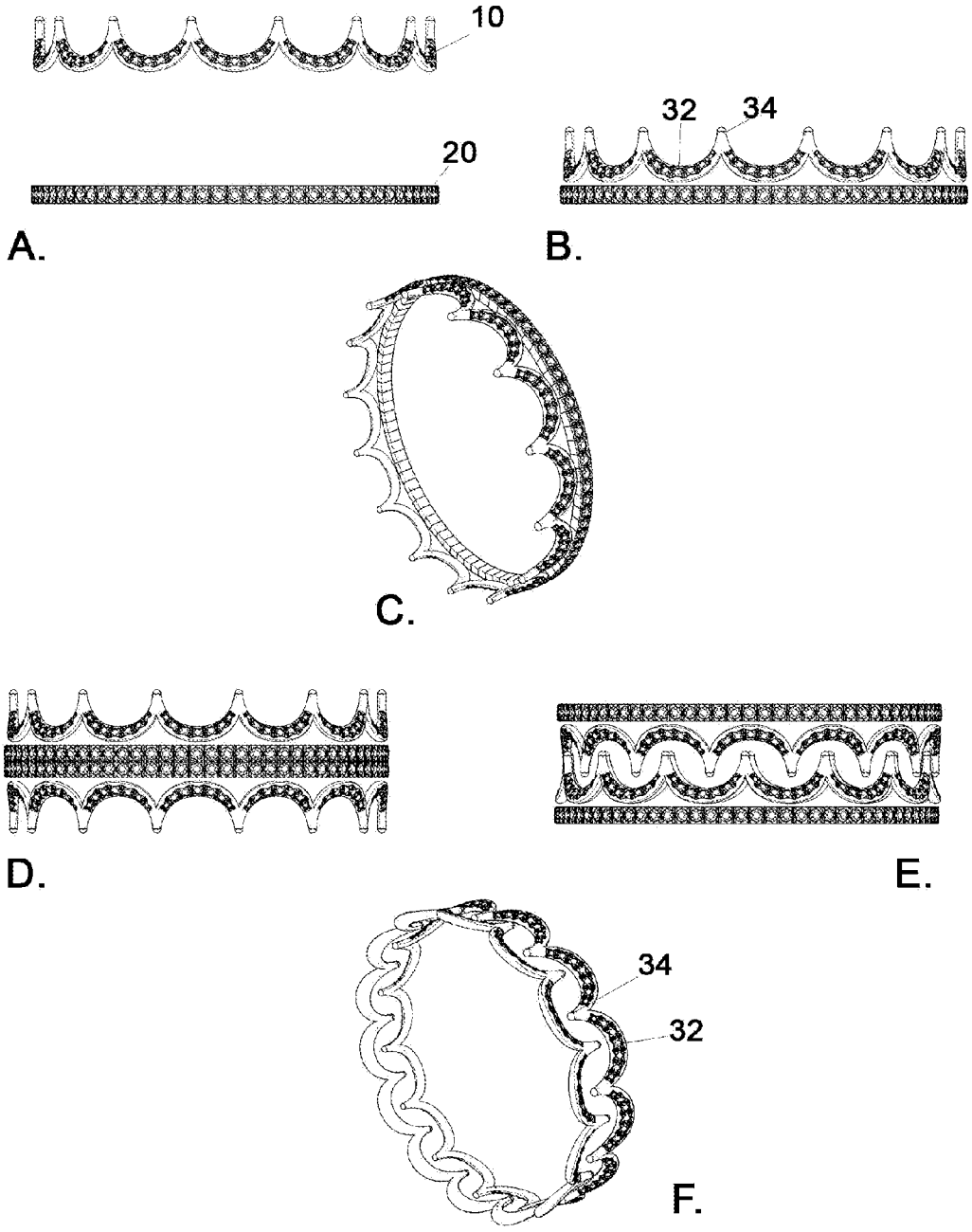

FIG. 10 A-F shows various assemblies to combine two shaped circular elements and/or two flat circular elements to form a unite bracelet structure.

A. Side view of one flat circular element and one shaped circular element shown separately.

B. Side view of one flat circular element and one shaped circular element shown to form a unite bracelet structure.

C. A top or bottom side view of assembly in A and B.

D. A side view of a bracelet having two flat circular elements forming a middle section and two shaped circular elements on both sides of the middle section with the bottoms of the U-shaped forms toward the middle section.

E. A side view of a bracelet having two flat circular elements forming a middle section and two shaped circular elements on both sides of the middle section with the bottoms of the U-shaped forms away from the middle section.

F. A perspective view of an assembly where to shaped circular elements form a bracelet.

Figure 11:
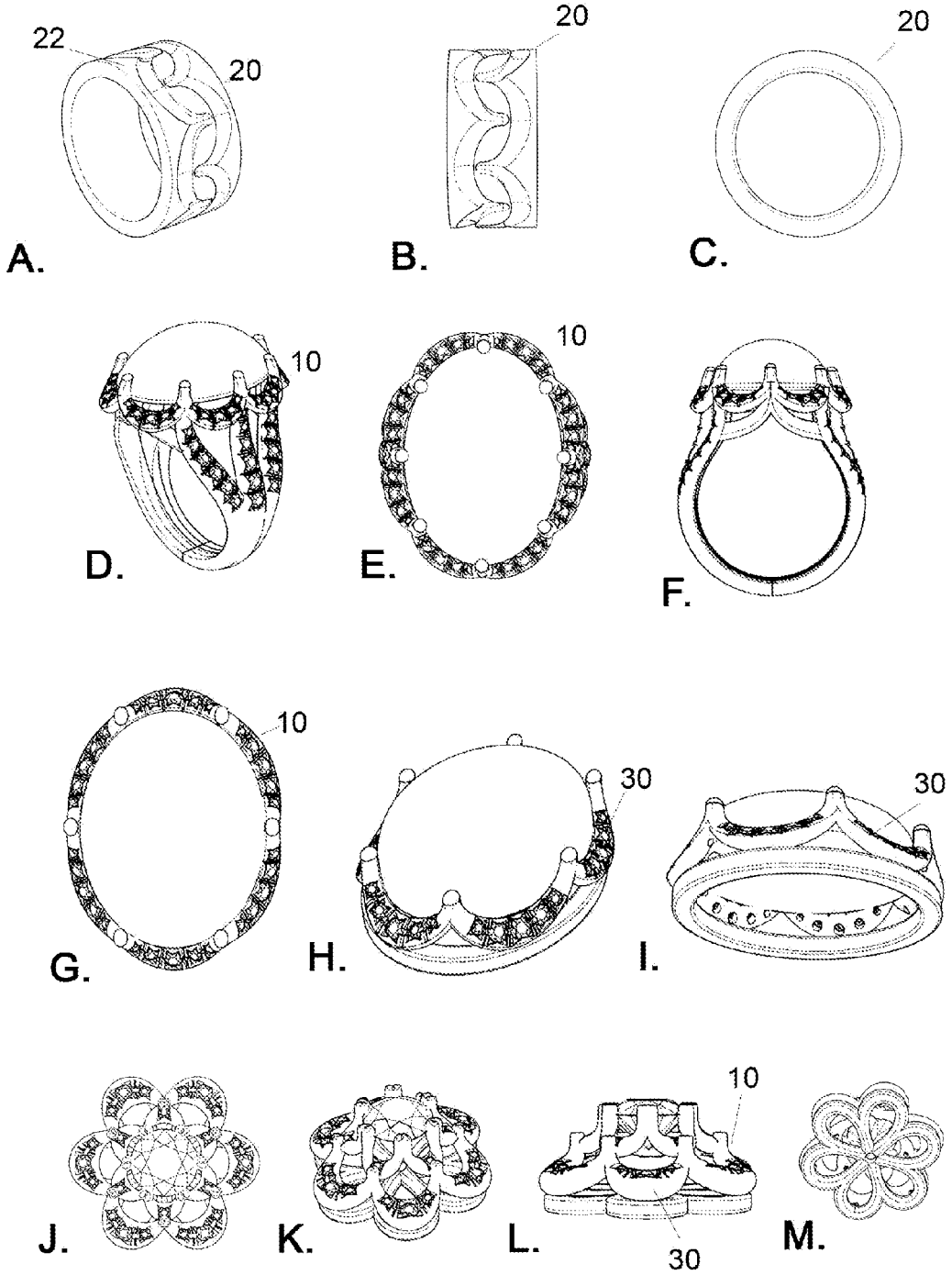

FIG. 11 A-M shows variations of elements matching with the multipart jewelry.

A. Side perspective view of a flat circular element, where the pattern of U-forms is part of the flat circular element.

B. Side view of A.

C. Bottom or top view of A and B.

D. A side perspective view of a ring having a socket for the crown with a shaped circular element with eight U-shaped forms.

E. Top view of D.

F. Side view of D.

G. A top view of a socket for a crown with six U-shaped forms.

H. A top perspective view of a socket for a crown with a shaped circular element six U-shaped forms and a flat circular element under the shaped circular element.

I. A bottom perspective view of H.

J. A top view of a pendant with a shaped circular element with U-shaped forms to hold a gem.

K. A top perspective view of a pendant with two shaped circular elements with U-shaped forms to hold the gem.

L. A side view of K.

M. A bottom view of K.

DETAILED DESCRIPTION OF THE PREFERRED EMBODIMENTS

A multi-piece jewelry where the jewelry is formed of interlockable and interchangeable shaped circular elements and additionally optional flat circular elements is disclosed.

The term "flat circular element" is used to distinguish these elements from the "shaped circular elements" that are formed of the substantially U-shaped elements.

A flat circular element may have straight edges or curved edges, it may be of any desired width, it may have embedded stones or patterns or it may have any desired openings on its side face.

The shaped circular element comprises a selected number of substantially U-shaped forms that are connected together to form the circular element. The U-shaped forms have two tips and a bottom and each adjacent U-shaped form shares a tip. Thereby, the circular element has as many tips and bottoms as it has U-shaped forms. For example, a circular element may have 6 U-shaped forms and thus it has 6 tips and 6 bottoms.

The substantially U-shaped elements may be U-shaped, they may also be V-shaped or they may be U-shaped with flat bottom.

The cross section of the flat circular elements as well as of the shaped circular elements may be flat, round, semi round, square or any other desired shape.

A kit comprising the elements is also disclosed to combine the elements in different ways to form a number of different designs. Any number of the flat circular elements can be used in a multi-piece jewelry with any number of shaped flat circular elements. Flat circular elements can be used alone and shaped circular elements can be used alone.

The jewelry of this invention may be a bracelet or ring. The kit may also comprise pendants, earrings, or other jewelry.

The invention is now described with reference to FIGS. 1-11. For the sake of simplicity the substantially U-shape forms are shown as pure U-shapes in the drawings, but the shape could also be C-shape or it may be a U-shape with flat bottom.

In FIGS. 1 A-D a shaped circular element 10 of the multi piece jewelry with six U-shaped forms 30 is shown. FIG. 1 A shows a side view of the shaped circular element. The element is formed of several substantially U-shaped forms 30. In FIG. 1 there are six U-shaped forms in the jewelry. Each substantially U-shaped form has a bottom 32 and two tips 34. Two adjacent substantially U-shaped forms 30 share one tip 34. Accordingly, in a shaped circular element with six substantially U-shaped forms 30 there are also six tips 34 and six bottoms 32.

FIG. 2 shows flat circular elements 20. The edges 25 of the flat circular element are shown to be straight but they may as well be curved or wavelike or any other desired shape.

FIG. 3 shows how two shaped circular elements 10 can be interlocked together. For example, in FIG. 3A it is shown how the tips 34 of the substantially U-shaped forms of one shaped circular element coincide with the bottoms 32 of the substantially U-shaped forms of the other shaped circular element.

FIG. 4 shows different ring assemblies that can be made of two flat circular elements 20 and two shaped circular elements 10. In this specific embodiment both of the circular elements (10, 20) include embedded gems.

FIG. 5 shows various ways to match two shaped circular elements 10 and two flat circular elements 20. In FIGS. 5 A and C the flat circular elements are in middle forming a middle section and the shaped circular elements are on both sides of the middle section. In FIGS. 5 E and F only two shaped circular elements are used. In FIG. 5 E the tips 34 of the substantially U-shaped forms are pointing away from the middle while in FIG. 5 F the tips point toward the middle.

FIG. 6 shows further ways to assemble two shaped circular elements 10 and two flat circular elements 20. In FIGS. 6A and 6 E the shaped circular elements 10 are in the middle forming a middle section and the flat circular elements 20 are on both sides of the middle section. In FIG. 6A the shaped circular elements 10 are so assembled that the bottoms 32 of the U-shaped forms of the two circular elements are in same direction and coincide with each other and the tips 34 of the substantially U-shaped forms point also to same direction and coincide. In FIG. 6E the tips 34 of the substantially U-shaped forms of the two shaped circular elements point to opposite directions and coincide whereby the substantially U-shaped forms 30 of the two shaped circular elements form a pattern of continuous chain of O-shapes. In FIG. 6C only two shaped circular elements are used and they are assembled also so that the substantially U-shaped forms of the two elements form a pattern of continuous chain of O-shapes.

If the substantially U-shaped forms were V-shaped, the continuous chain of O-shapes in FIG. 6C would appear to be a continuous chain of diamond-shapes. If the substantially U-shaped forms had a flat bottom, the continuous chain of O-shapes in FIG. 6C would appear to be continuous chain of square-shapes.

FIG. 7 shows one preferred embodiment where a shaped circular element 10 has five substantially U-shaped forms 30, five tips 34 and five bottoms 32 of the substantially U-shaped forms. FIG. 7D-F shows how two shaped circular elements are interlocked by having the tips of one shaped element coincide with the bottoms 32 of the other shaped element.

FIG. 8 shows another preferred embodiment where a shaped circular element 10 has four substantially U-shaped forms 30, four tips 34 and four bottoms 32 of the substantially U shaped forms. FIG. 8D shows how two shaped circular elements are interlocked by having the tips of one shaped element coincide with the bottoms 32 of the other shaped element.

FIG. 9 shows another preferred embodiment where a shaped circular element 10 has three substantially U-shaped forms 30, three tips 34 and three bottoms 32 of the substantially U shaped forms. FIG. 9D-E shows how two shaped circular elements are interlocked by having the tips of one shaped element coincide with the bottoms 32 of the other shaped element. FIGS. 9 G-I show two flat circular elements 20 used together with the two shaped circular forms 10.

The number and size of the substantially U shaped elements 30 in the shaped circular element 10 may be selected to be anything bigger than two. FIG. 1 shows six substantially U-shaped forms, FIG. 7 shows five U-shaped forms; FIG. 8 shows four substantially U-shaped forms and FIG. 9 shows three U-shaped forms. By amending the number and/or the size of the substantially U-shaped elements one can get a larger circular element. Smaller circular elements may be used as rings. In a ring the shaped circular element preferably has 3-8 substantially U-shaped forms, more preferably 4-7 substantially U-shaped forms and most preferably 5-6 substantially U-shaped forms. Larger may be used as bracelets. In a bracelet the shaped circular element preferably has 10-30 substantially U-shaped forms, more preferably 12-24 substantially U-shaped forms and most preferably 14-18 substantially U-shaped forms.

FIG. 10 shows another preferred embodiment where a shaped circular element 10 has fourteen substantially U-shaped forms 30, fourteen tips 34 and fourteen bottoms 32 of the substantially U shaped forms. FIG. 10 A-C shows a bracelet made of a combination of one flat circular element 20 and one shaped circular element 10. FIG. 10 D-E shows a bracelet with two flat circular elements and two shaped circular elements. FIG. 10 F shows a bracelet with two shaped circular elements.

The side face 22 of the flat circular element 20 may have a pattern of substantially U-shaped forms as is shown in FIGS. 11 A and B.

According to embodiment of this invention, a kit with several flat circular elements and several shaped circular elements is provided with a manual showing the possible assemblies. According to one preferred embodiment the kit may also contain other matching jewelry. FIG. 11J-M shows a matching pendent, where the pendent may have one or two shaped circular elements 10 made of substantially U-shaped forms 30. FIG. 11 D-I show a stone attached to a crown with matching shaped circular elements made of substantially U-shaped.

It is to be understood that the material of the elements may be any feasible material, including but not limited to silver, and gold. The elements may include any kind of stones, including but not limited to diamonds. Furthermore, it is understood that the thickness and width of the circular elements may vary. Also one skilled in the art would understand that the jewelry made of the circular elements of this invention may include other jewelry than rings and bracelets. Such other jewelry may be tiaras, necklaces, hair accessories and such.

What is claimed is:

1. A shaped circular element for a multi-piece jewelry, said shaped circular element comprising a multitude of substantially U-shaped forms connected to each other, said U-shaped forms having a bottom and two tips and each adjacent substantially U-shaped form sharing one tip, whereby the element has an equal number of tips, bottoms and substantially U-shaped forms, wherein said two tips are substantially hemispherical, wherein the element has at least three substantially U-shaped forms, wherein the element is a part of a multipart bracelet and has 14-18 substantially U-shaped forms.

2. A multi-piece jewelry comprising one or more of the shaped circular elements of claim 1 and one or more flat circular elements.

3. The multi-piece jewelry of claim 2, wherein the jewelry has two flat circular elements and two shaped circular elements.

4. The multi-piece jewelry of claim 3, wherein the shaped circular elements are interlocked together by assembling the bottoms of the substantially U-shaped forms of one shaped circular element to match the bottoms of the substantially U-shaped forms of the other shaped circular element.

5. The jewelry of claim 3, wherein the jewelry is selected from the group consisting of a ring, and a bracelet.

6. A multi-piece jewelry, comprising at least one flat circular element and at least one shaped circular element, said shaped circular element comprising a multitude of substantially U-shaped forms connected to each other, said substantially U-shaped forms having a bottom and two tips and each adjacent substantially U-shaped form sharing one tip, whereby the element has an equal number of tips, bottoms and substantially U-shaped forms, wherein said tips are substantially hemispherical.

7. A multi-piece jewelry, comprising at least two shaped circular elements, said shaped elements comprising a multitude of substantially U-shaped forms connected to each other, said substantially U-shaped forms having a bottom and two tips and each adjacent substantially U-shaped form sharing one tip, whereby the element has an equal number of tips, bottoms and substantially U-shaped forms, wherein said tips are substantially hemispherical, and wherein shaped circular elements may interlock together to form a united structure with at least one gap between said shaped circular elements.

8. A kit to form a multi-piece jewelry, said kit comprising at least one flat circular element, at least one shaped circular element having a multitude of substantially U-shaped forms connected to each other, said substantially U-shaped forms having a bottom and two tips and each adjacent substantially U-shaped form sharing one tip, whereby the tips are hemispherical and the shaped circular element has an equal number of tips, bottoms; and instructions to interlock the shaped elements and to combine the circular elements in multiple ways to form different designs of jewelry with at least one gap in said design of jewelry.

9. The kit of claim 8, wherein the circular elements can be combined to form a ring.

10. The kit of claim 8, wherein the circular elements can be combined to form a bracelet.

11. The kit of claim 8, wherein the kit additionally comprises pendants, earrings, hair accessories or crowns having structures with similar look as the shaped circular elements formed of substantially U-shaped forms.

* * * * *